US008597163B2

(12) United States Patent
Chiu

(10) Patent No.: US 8,597,163 B2
(45) **Date of Patent: *Dec. 3, 2013**

(54) GYRATION TYPE EXERCISING DEVICE THAT CAN EXERCISE A USER'S BODY COMPLETELY

(75) Inventor: Ciber Chiu, Changhua County (TW)

(73) Assignee: Famosa Corp., Changhua County (TW)

( * ) Notice: Subject to any disclaimer, the term of this patent is extended or adjusted under 35 U.S.C. 154(b) by 421 days.

This patent is subject to a terminal disclaimer.

(21) Appl. No.: 12/908,259

(22) Filed: Oct. 20, 2010

(65) Prior Publication Data

US 2012/0100971 A1 Apr. 26, 2012

Related U.S. Application Data

(63) Continuation-in-part of application No. 12/625,539, filed on Nov. 24, 2009, now Pat. No. 8,167,779.

(51) Int. Cl.
*A63B 21/22* (2006.01)

(52) U.S. Cl.
USPC ..... 482/110; 482/148

(58) Field of Classification Search
USPC ..... 482/51–53, 57–65, 110, 148, 146, 147, 482/92
See application file for complete search history.

(56) References Cited

U.S. PATENT DOCUMENTS

| | | | | |
|---|---|---|---|---|
| 2,387,966 | A | 10/1945 | Gustaf | 482/92 |
| 5,039,091 | A | 8/1991 | Johnson | 482/64 |
| 5,050,871 | A | 9/1991 | Douglas et al. | 482/110 |
| 5,766,115 | A * | 6/1998 | Huang | 482/110 |
| 5,888,179 | A * | 3/1999 | Singhal | 482/81 |
| 6,719,675 | B2 | 4/2004 | Yu | 82/110 |
| 7,491,158 | B1 | 2/2009 | Danaei-Boroumand | 482/110 |
| 7,713,178 | B2 | 5/2010 | Edmondson | 482/70 |
| 8,167,779 | B2 * | 5/2012 | Chiu | 482/110 |
| 2009/0156377 | A1 | 6/2009 | Brown | 482/110 |

* cited by examiner

*Primary Examiner* — Stephen Crow
(74) *Attorney, Agent, or Firm* — Alan Kamrath; Kamrath IP Lawfirm, P.A.

(57) ABSTRACT

A gyration type exercising device includes a gyration unit (10), a damper (20) and a drive handle (30). The gyration unit includes a mounting frame (11) and a rotation wheel (12) rotatably mounted on the mounting frame and driven by the drive handle. The rotation wheel is provided with a rotation shaft (121). The drive handle has a first end pivotally connected with the rotation wheel and a second end provided with a holding bar (31). Thus, when the user's two hands hold the holding bar to move the drive handle in a gyration manner, the user's body has to move forward and backward and has to exert a force on the drive handle successively to rotate the rotation wheel reciprocally so as to exercise the user's body completely.

11 Claims, 17 Drawing Sheets

GYRATION TYPE EXERCISING DEVICE THAT CAN EXERCISE A USER'S BODY COMPLETELY

CROSS REFERENCE

The present application is a continuation-in-part of U.S. application Ser. No. 12/625,539 filed Nov. 24, 2009.

BACKGROUND OF THE INVENTION

1. Field of the Invention

The present invention relates to an exercising device and, more particularly, to a gyration type exercising device.

2. Description of the Related Art

A conventional exercising device comprises a housing 50, a front rotation mechanism 60 mounted on the front side of the housing 50, a rear rotation mechanism 70 mounted on the rear side of the housing 50, a gear unit 52 mounted in the housing 50 and connected with the front rotation mechanism 60 and the rear rotation mechanism 70 to control movement of the front rotation mechanism 60 and the rear rotation mechanism 70, and a drive motor 51 mounted in the housing 50 and connected with the gear unit 52 to drive the gear unit 52. The front side of the housing 50 is provided with a mounting tube 53. The front rotation mechanism 60 includes a rotation upright 61 rotatably mounted in the mounting tube 53 and rotated by the gear unit 52, a retractable bar 62 mounted on the upper end of the rotation upright 61, a connecting rod 63 rotatably mounted on the retractable bar 62, and a T-shaped handle 64 having a first end mounted on the connecting rod 63 and a second end provided with a grip 641. The rear rotation mechanism 70 includes a rotation post 71 rotatably mounted in the housing 50 and rotated by the gear unit 52, an elbow 711 mounted on the upper end of the rotation post 71, a transverse bar 72 mounted on the elbow 711, a roller 74 rotatably mounted on the bottom of the transverse bar 72 and movable on the top of the housing 50, and a rotation disk 73 rotatably mounted on the top of the transverse bar 72. When in use, a user is placed on the exercising device with his feet treading the rotation disk 73 and with his hands holding the grip 641. Thus, when the gear unit 52 is driven by the drive motor 51, the front rotation mechanism 60 and the rear rotation mechanism 70 are rotated by the gear unit 52 simultaneously to swivel the user's body so as to achieve an exercising effect. However, the user is moved by operation of the drive motor 51 so that the user does not move his body by himself, thereby decreasing the exercising effect of the exercising device.

BRIEF SUMMARY OF THE INVENTION

In accordance with the present invention, there is provided a exercising device, comprising a gyration unit, a damper mounted on the gyration unit and a drive handle connected with the gyration unit. The gyration unit includes a mounting frame and a rotation wheel rotatably mounted on the mounting frame and driven by operation of the drive handle. The rotation wheel of the gyration unit is provided with a rotation shaft which is rotatably mounted on the mounting frame. The damper is mounted on the mounting frame of the gyration unit and has a side pressing a periphery of the rotation wheel to provide a damping force to the rotation wheel of the gyration unit.

The primary objective of the present invention is to provide a gyration type exercising device that can exercise a user's body completely.

According to the primary advantage of the present invention, when the user's two hands hold the holding bar to move the drive handle in a gyration manner, the user's body has to move forward and backward in a reciprocal manner and has to exert a force on the drive handle successively to rotate the rotation wheel reciprocally so as to exercise the user's body completely, thereby enhancing the exercising effect.

According to another advantage of the present invention, the adjusting member is movable on the mounting frame to move the damper relative to the rotation wheel so as to adjust the resistance and damping force of the damper applied on the rotation wheel.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
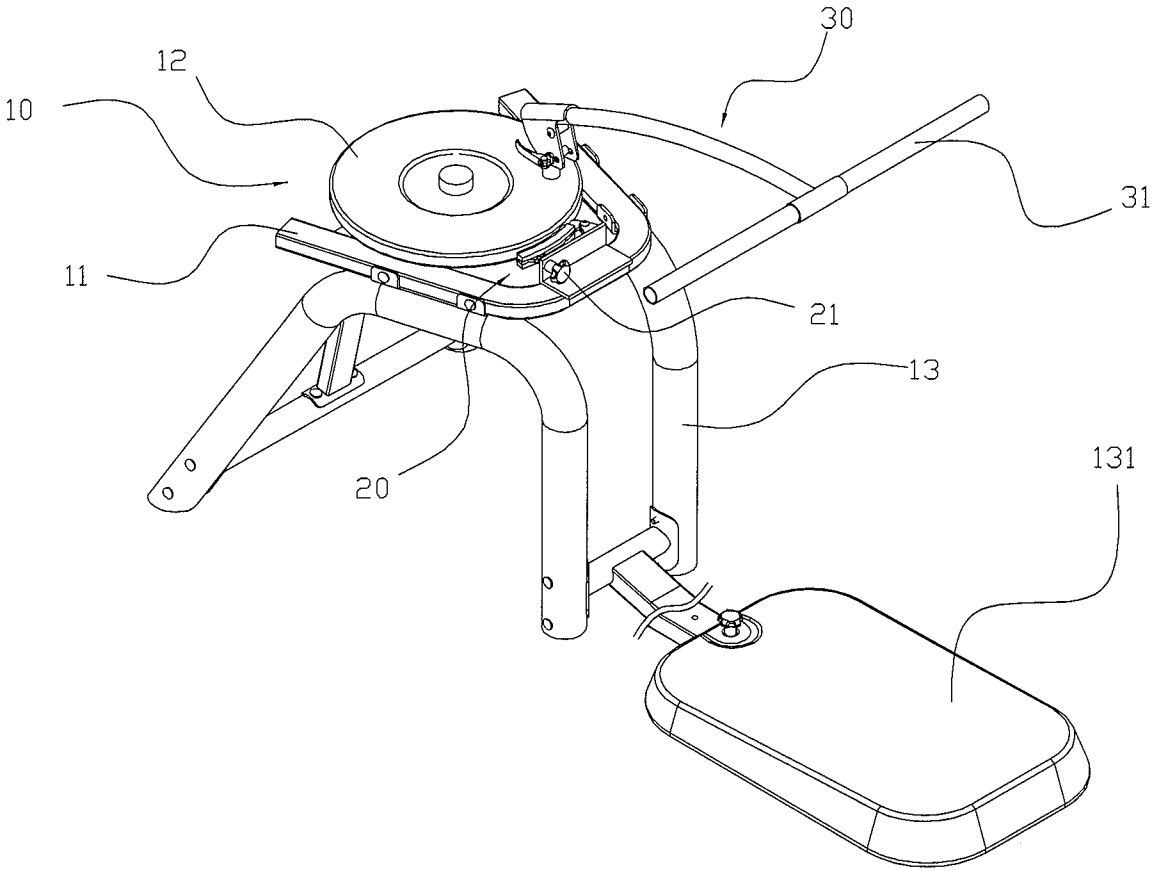
FIG. 1 is a perspective view of a gyration type exercising device in accordance with the preferred embodiment of the present invention.

Referring to the drawings and initially to FIGS. 1-4, a gyration type exercising device in accordance with the preferred embodiment of the present invention comprises a gyration unit 10, a damper 20 mounted on the gyration unit 10 and a drive handle 30 connected with the gyration unit 10.

The gyration unit 10 includes a mounting frame 11 and a rotation wheel 12 rotatably mounted on the mounting frame 11 and driven by operation of the drive handle 30. The rotation wheel 12 of the gyration unit 10 is provided with a rotation shaft 121 which is rotatably mounted on the mounting frame 11. The rotation shaft 121 is secured on and located at a central portion of the rotation wheel 12 so that the rotation wheel 12 is rotatable about the rotation shaft 121.

The damper 20 is mounted on the mounting frame 11 of the gyration unit 10 and has a side pressing a periphery of the rotation wheel 12 to provide a damping force to the rotation wheel 12 of the gyration unit 10. The damper 20 provides a damping force to the rotation wheel 12 of the gyration unit 10 in a frictional, magnetically attractive or generator manner.

The gyration type exercising device further comprises a tension adjusting member 21 mounted on the mounting frame 11 of the gyration unit 10 and connected with the damper 20 to move the damper 20 relative to the rotation wheel 12 of the gyration unit 10 so as to adjust the damping force of the damper 20 applied on the rotation wheel 12 of the gyration unit 10.

The drive handle 30 is pivotally connected with the rotation wheel 12 of the gyration unit 10. The drive handle 30 has a first end pivotally connected with the rotation wheel 12 of the gyration unit 10 and a second end provided with a holding bar 31. The first end of the drive handle 30 is arranged eccentrically on the rotation wheel 12 of the gyration unit 10. The holding bar 31 is perpendicular to the drive handle 30.

The gyration type exercising device further comprises a support rack 13 mounted on a bottom of the mounting frame 11 to support the mounting frame 11 of the gyration unit 10, and a tread cushion 131 mounted on a side of the support rack 13.

Figure 2:
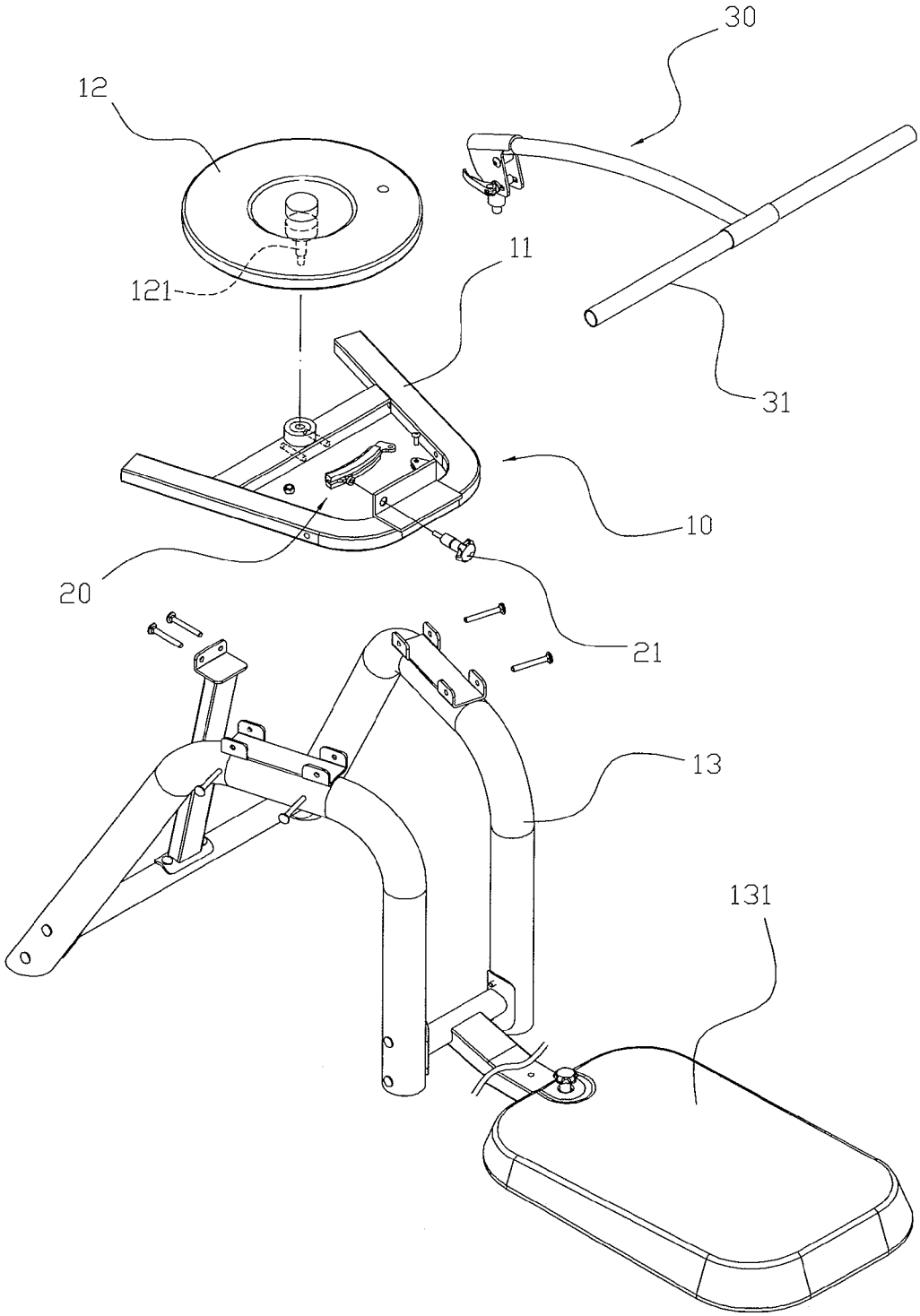
FIG. 2 is an exploded perspective view of the gyration type exercising device as shown in FIG. 1.
Figure 3:
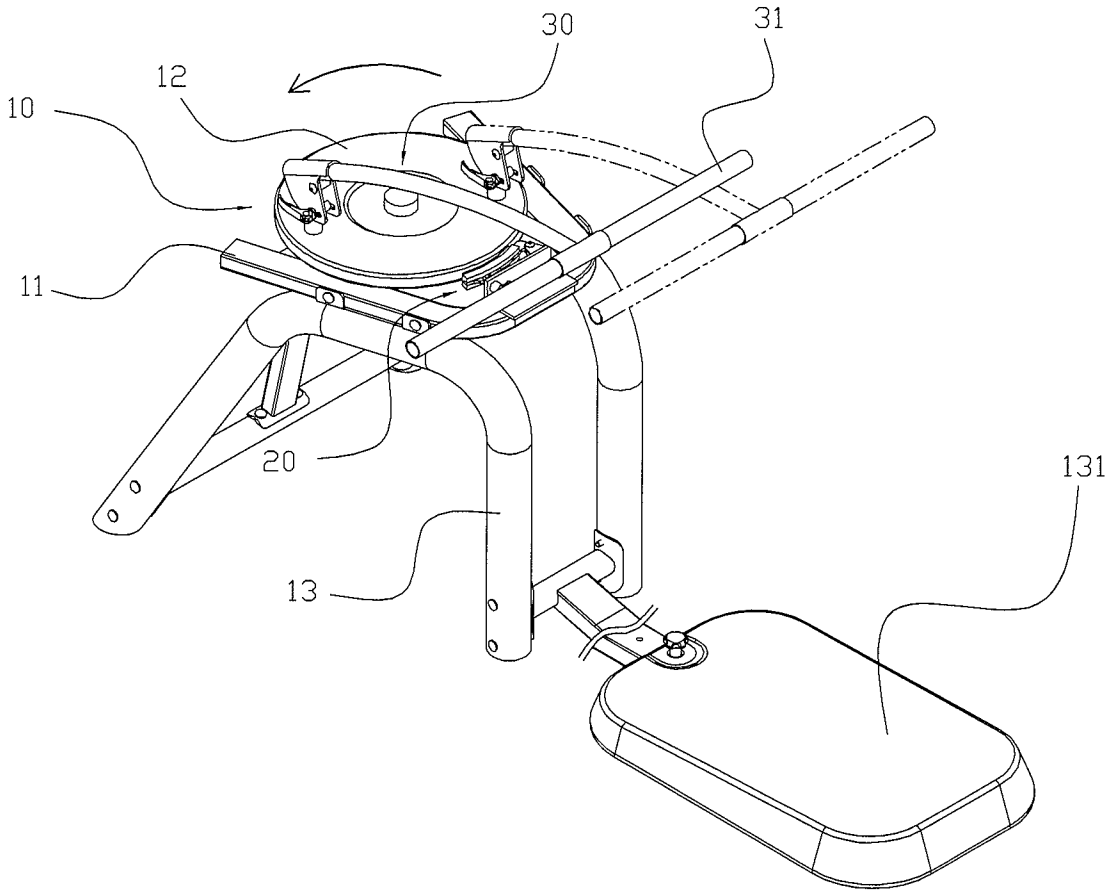
FIG. 3 is a schematic operational view of the gyration type exercising device as shown in FIG. 1.
Figure 4:
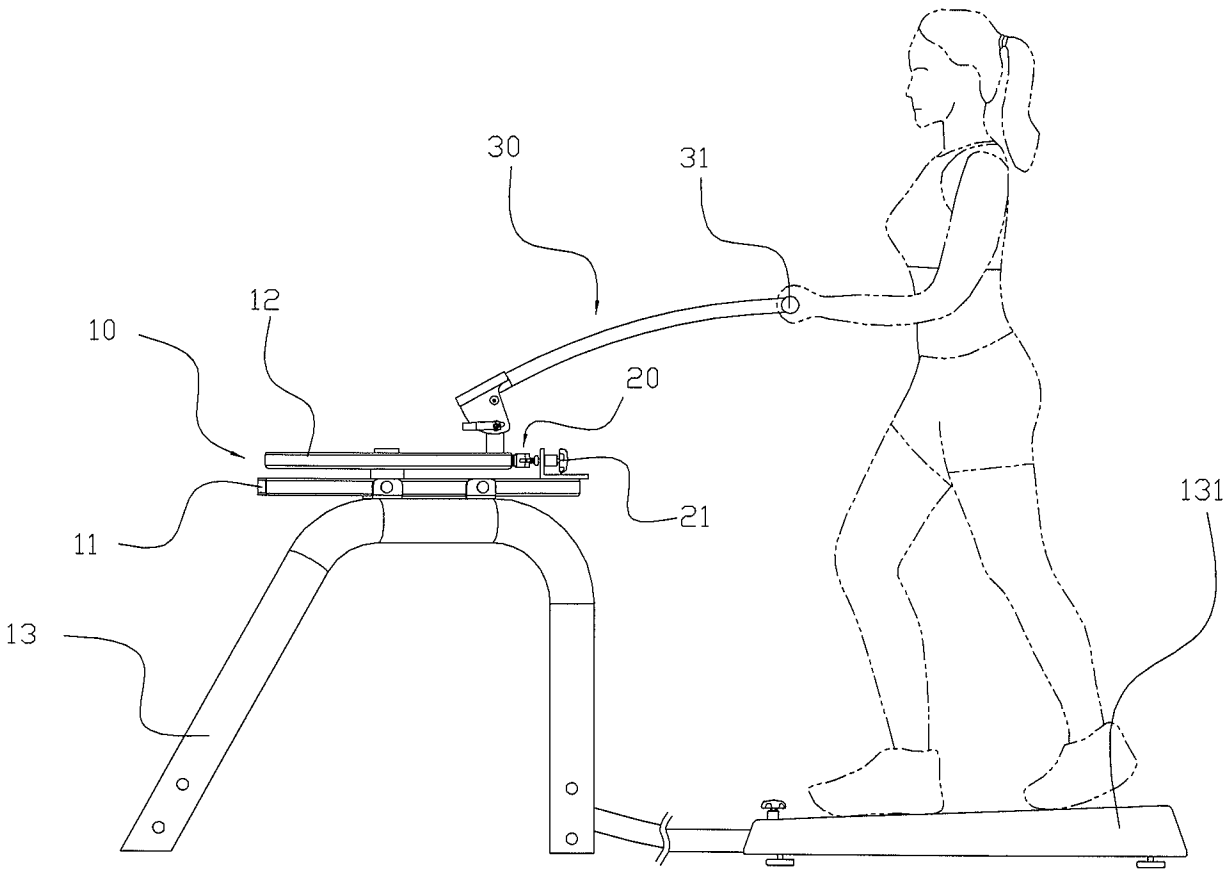
FIG. 4 is a schematic side operational view of the gyration type exercising device as shown in FIG. 1.

In operation, referring to FIGS. 3 and 4 with reference to FIGS. 1 and 2, the mounting frame 11 of the gyration unit 10 is placed on and supported by the support rack 13. Thus, a user's two hands can hold the holding bar 31 to drive and move the drive handle 30 in a gyration manner so that the drive handle 30 is moved and revolved forward and backward to gyrate and rotate the rotation wheel 12 about the rotation shaft 121 reciprocally. In such a manner, the user has to exert a force on the drive handle 30 successively to rotate the rotation wheel 12 about the rotation shaft 121 reciprocally so as to exercise the user's body completely.

Figure 5:
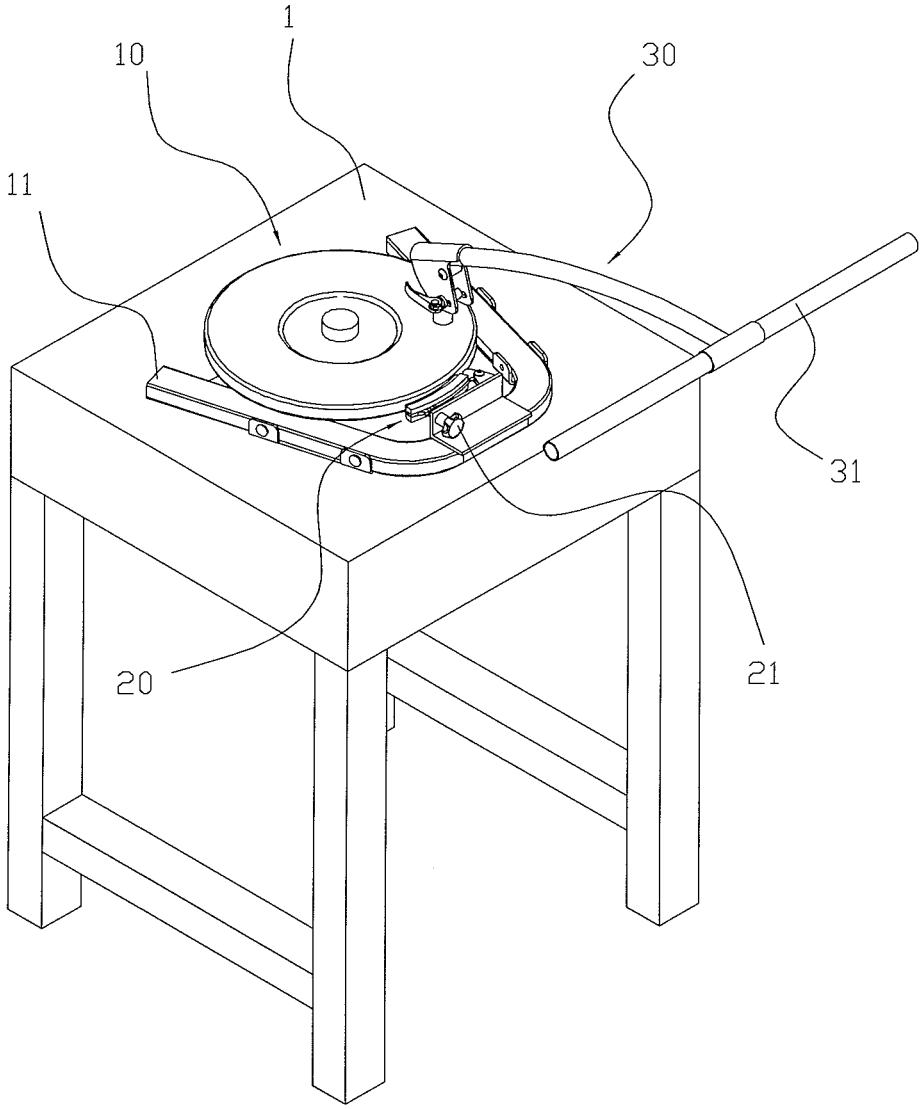
FIG. 5 shows that the gyration type exercising device is placed on a table.

As shown in FIG. 5, the mounting frame 11 of the gyration unit 10 is placed on and supported by a table 1.

Figure 6:
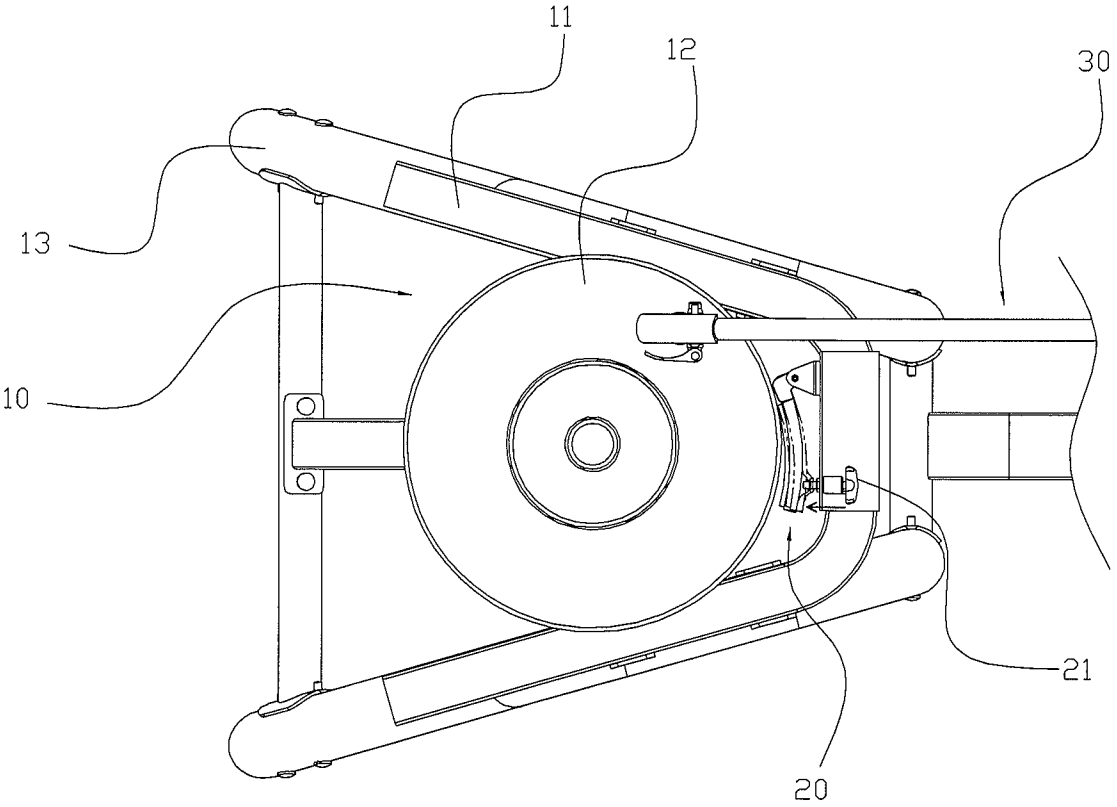
FIG. 6 is a schematic top operational view of the gyration type exercising device as shown in FIG. 1.

As shown in FIG. 6, the adjusting member 21 is movable on the mounting frame 11 of the gyration unit 10 to move the damper 20 relative to the rotation wheel 12 of the gyration unit 10 so as to adjust the damping force of the damper 20 applied on the rotation wheel 12 of the gyration unit 10.

Figure 7:
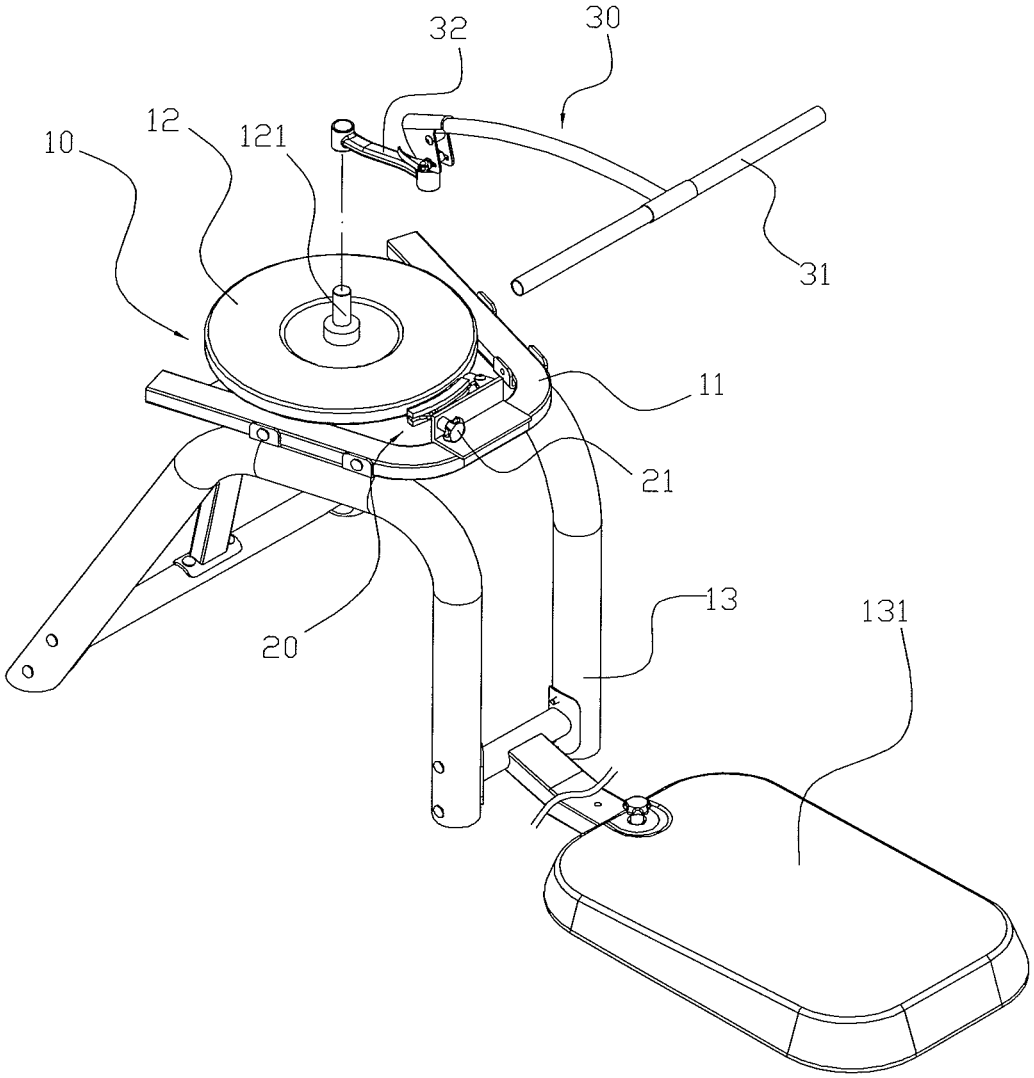
FIG. 7 is a partially exploded perspective view of a gyration type exercising device in accordance with another preferred embodiment of the present invention.

Referring to FIG. 7, the rotation shaft 121 protrudes outward from the rotation wheel 12 of the gyration unit 10, and the gyration type exercising device further comprises a crank 32 mounted between the rotation shaft 121 and the drive handle 30 and having a first end secured on the rotation shaft 121 to rotate the rotation shaft 121 and a second end pivotally connected with the drive handle 30 to move in concert with the drive handle 30. Thus, the crank 32 is driven by the drive handle 30 to rotate the rotation shaft 121 so as to rotate the rotation wheel 12.

Referring to FIGS. 8-12, the gyration type exercising device further comprises a transmission mechanism 40 mounted between the gyration unit 10 and the drive handle 30 to transmit a power of the drive handle 30 to the gyration unit 10. The gyration unit 10 further includes a driven member 122 secured on the rotation shaft 121 to rotate the rotation shaft 121. Preferably, the driven member 122 of the gyration unit 10 is a driven wheel.

The transmission mechanism 40 includes a drive member 42 rotatably mounted on the mounting frame 11 of the gyration unit 10 and a transmission member 41 mounted between the drive member 42 and the driven member 122 of the gyration unit 10 to transmit a power of the drive member 42 to the driven member 122 of the gyration unit 10. Preferably, the drive member 42 of the transmission mechanism 40 is a drive wheel and has a diameter greater than that of the driven member 122 of the gyration unit 10. In addition, the transmission member 41 of the transmission mechanism 40 is a belt.

The drive handle 30 is pivotally connected with the transmission mechanism 40. The drive handle 30 has a first end pivotally connected with the drive member 42 of the transmission mechanism 40 and a second end provided with a holding bar 31. The first end of the drive handle 30 is arranged eccentrically on the drive member 42 of the transmission mechanism 40.

Figure 8:
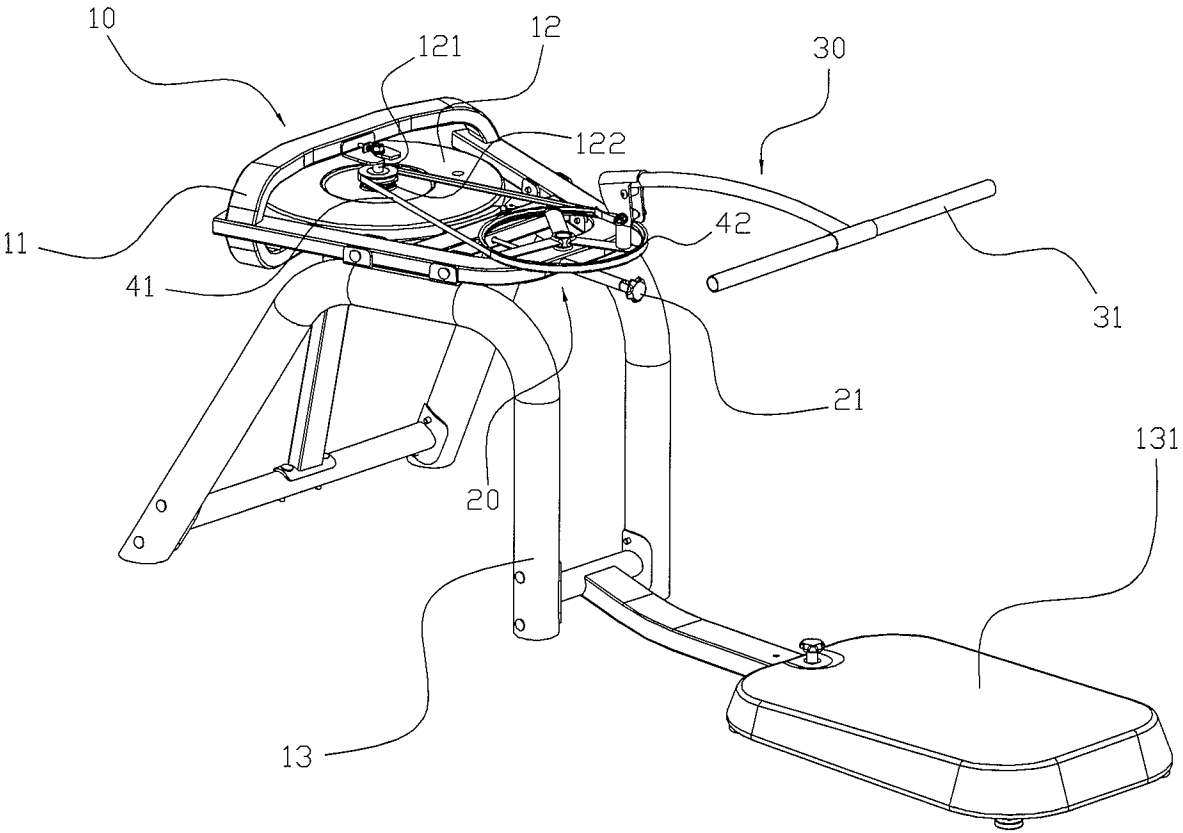
FIG. 8 is a perspective view of a gyration type exercising device in accordance with another preferred embodiment of the present invention.
Figure 9:
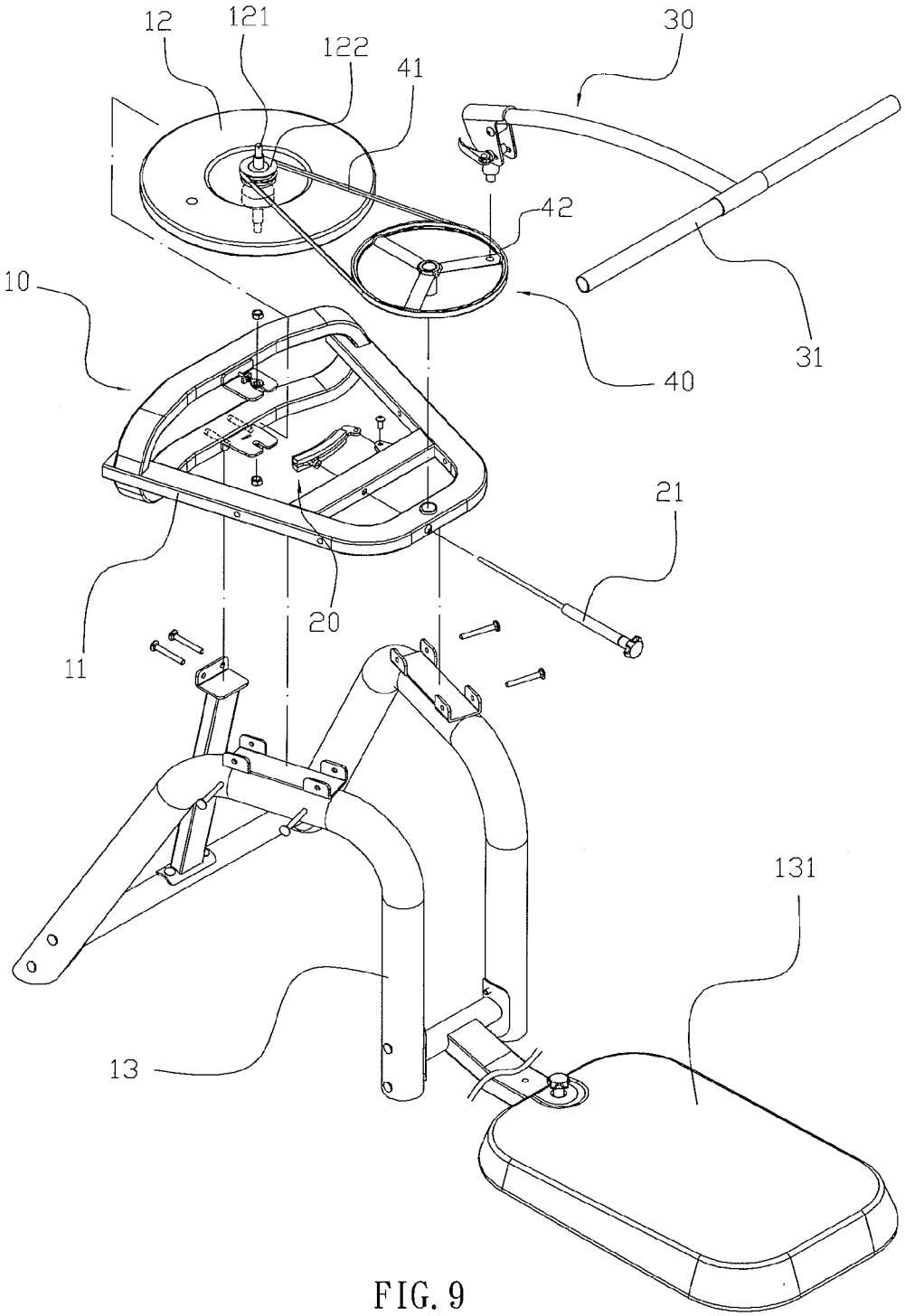
FIG. 9 is an exploded perspective view of the gyration type exercising device as shown in FIG. 8.
Figure 10:
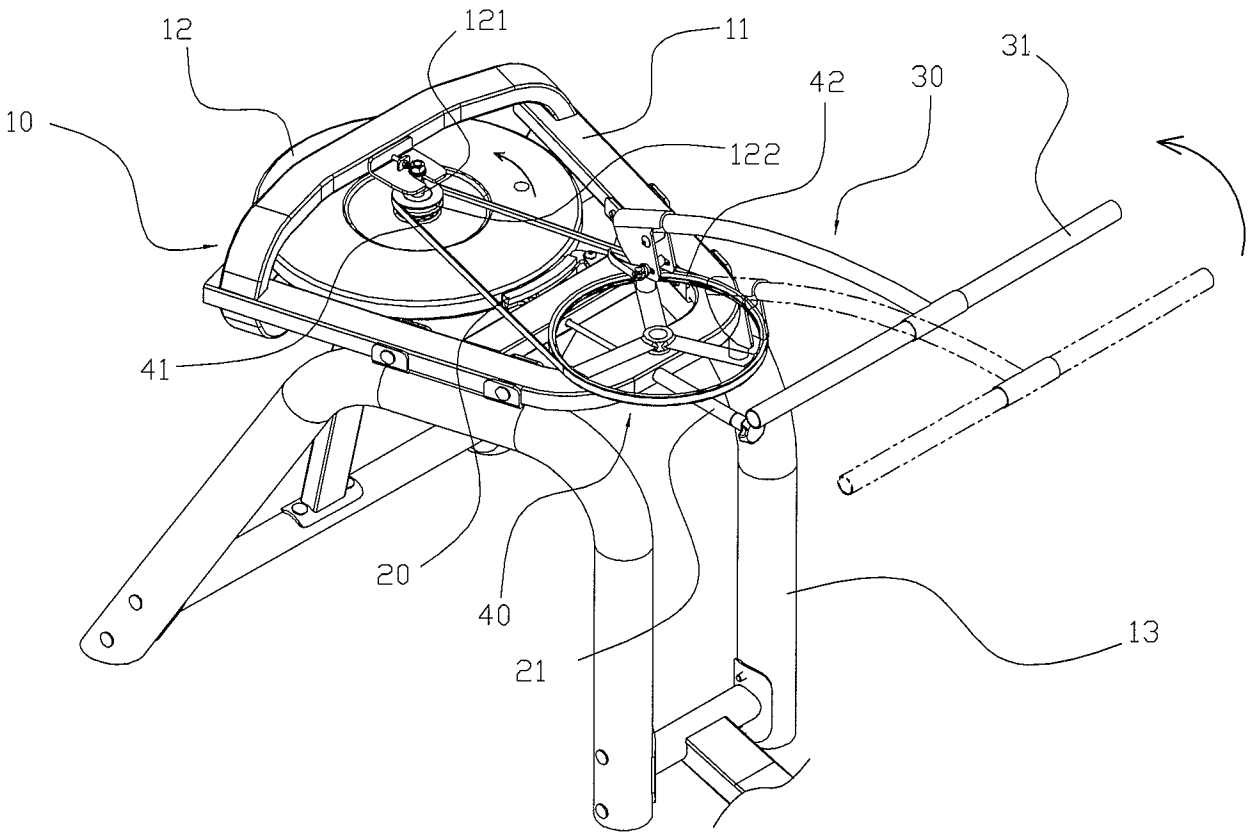
FIG. 10 is a schematic operational view of the gyration type exercising device as shown in FIG. 8.
Figure 11:
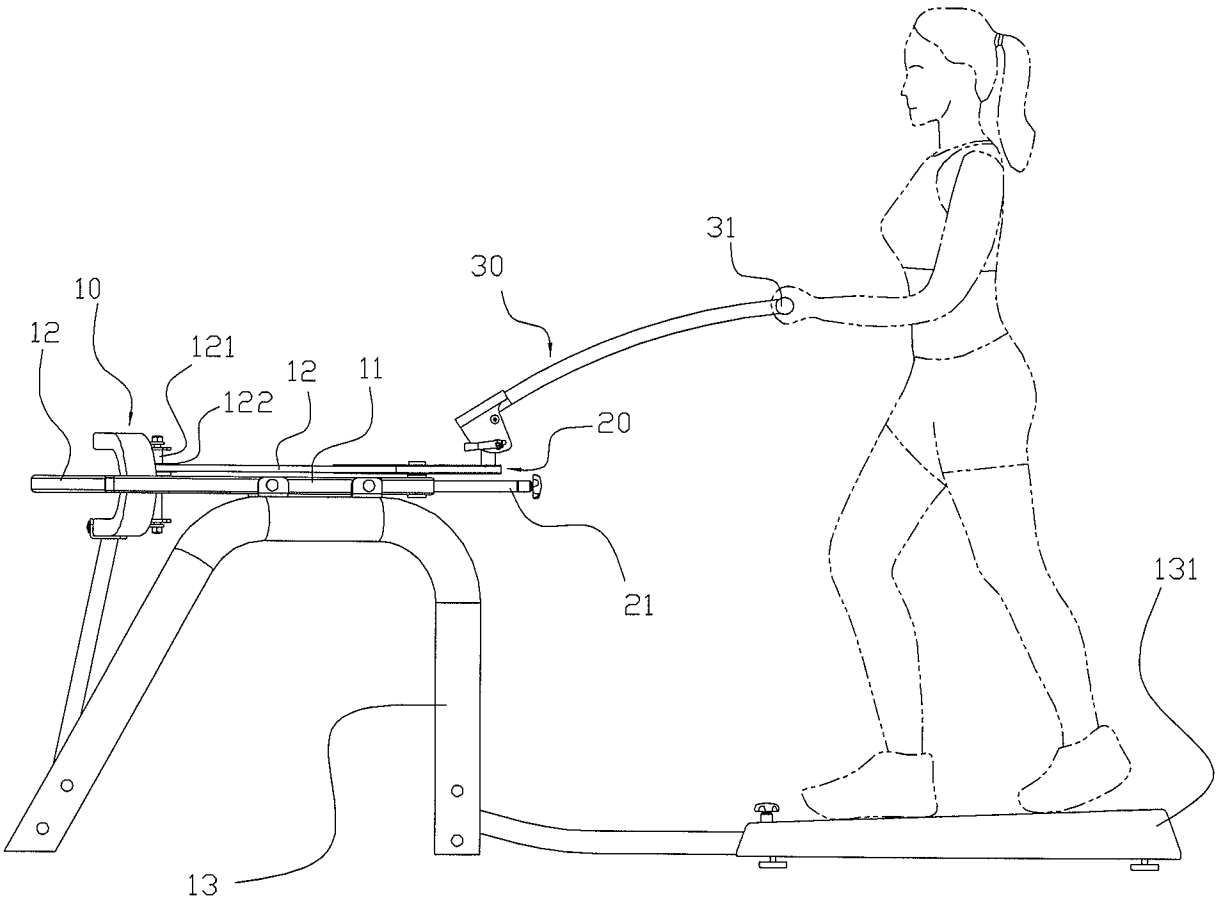
FIG. 11 is a schematic side operational view of the gyration type exercising device as shown in FIG. 8.
Figure 12:
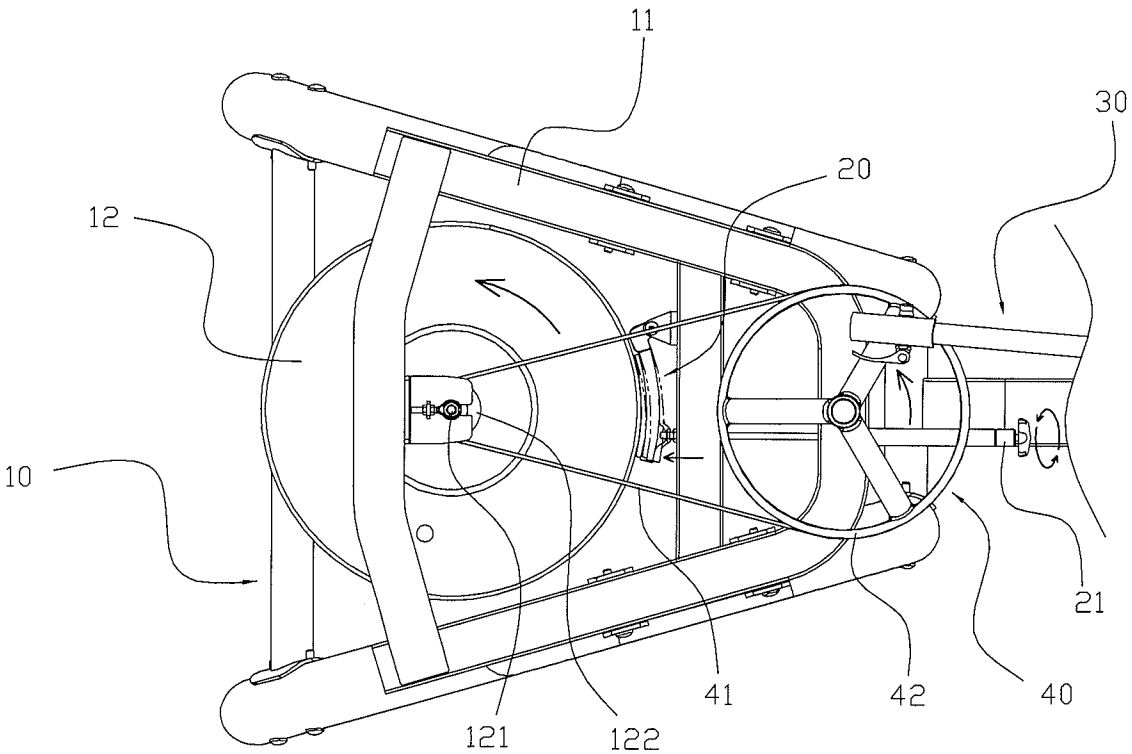
FIG. 12 is a schematic top operational view of the gyration type exercising device as shown in FIG. 8.

In operation, referring to FIGS. 10-12 with reference to FIGS. 8 and 9, the mounting frame 11 of the gyration unit 10 is placed on and supported by the support rack 13. Thus, a user's two hands can hold the holding bar 31 to drive and move the drive member 42 which drives the transmission member 41 which drives the driven member 122 which drives the rotation shaft 121 which rotates the rotation wheel 12 so that the rotation wheel 12 is rotated by driving of the drive handle 30. In such a manner, the user has to exert a force on the drive handle 30 successively to rotate the rotation wheel 12 reciprocally so as to exercise the user's body completely.

Figure 13:
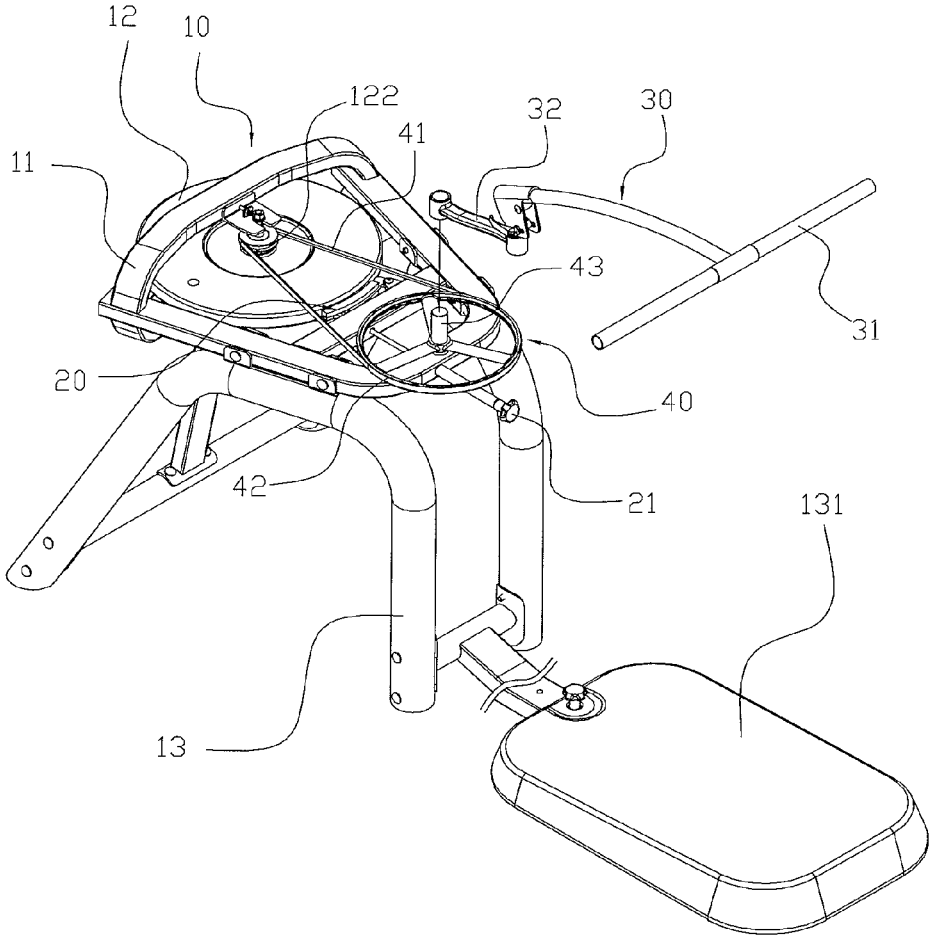
FIG. 13 is a partially exploded perspective view of a gyration type exercising device in accordance with another preferred embodiment of the present invention.

Referring to FIG. 13, the drive member 42 of the transmission mechanism 40 has a central portion provided with a rotation rod 43, and the gyration type exercising device further comprises a crank 32 mounted between the transmission mechanism 40 and the drive handle 30 and having a first end secured on the rotation rod 43 to rotate the rotation rod 43 and the drive member 42 and a second end pivotally connected with the drive handle 30 to move in concert with the drive handle 30. Thus, the crank 32 is driven by the drive handle 30 to rotate the rotation rod 43 which rotates the drive member 42 which drives the transmission member 41 which drives the driven member 122 which drives the rotation shaft 121 which rotates the rotation wheel 12 so that the rotation wheel 12 is rotated by driving of the drive handle 30.

Figure 14:
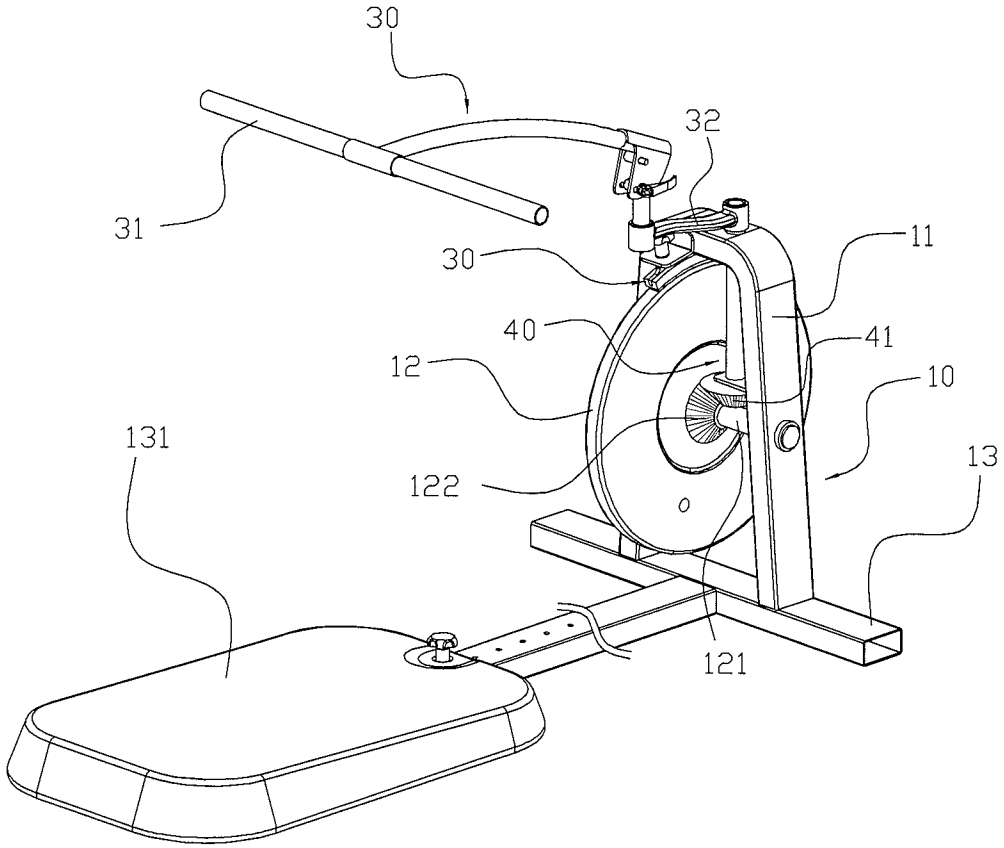
FIG. 14 is a perspective view of a gyration type exercising device in accordance with another preferred embodiment of the present invention.
Figure 15:
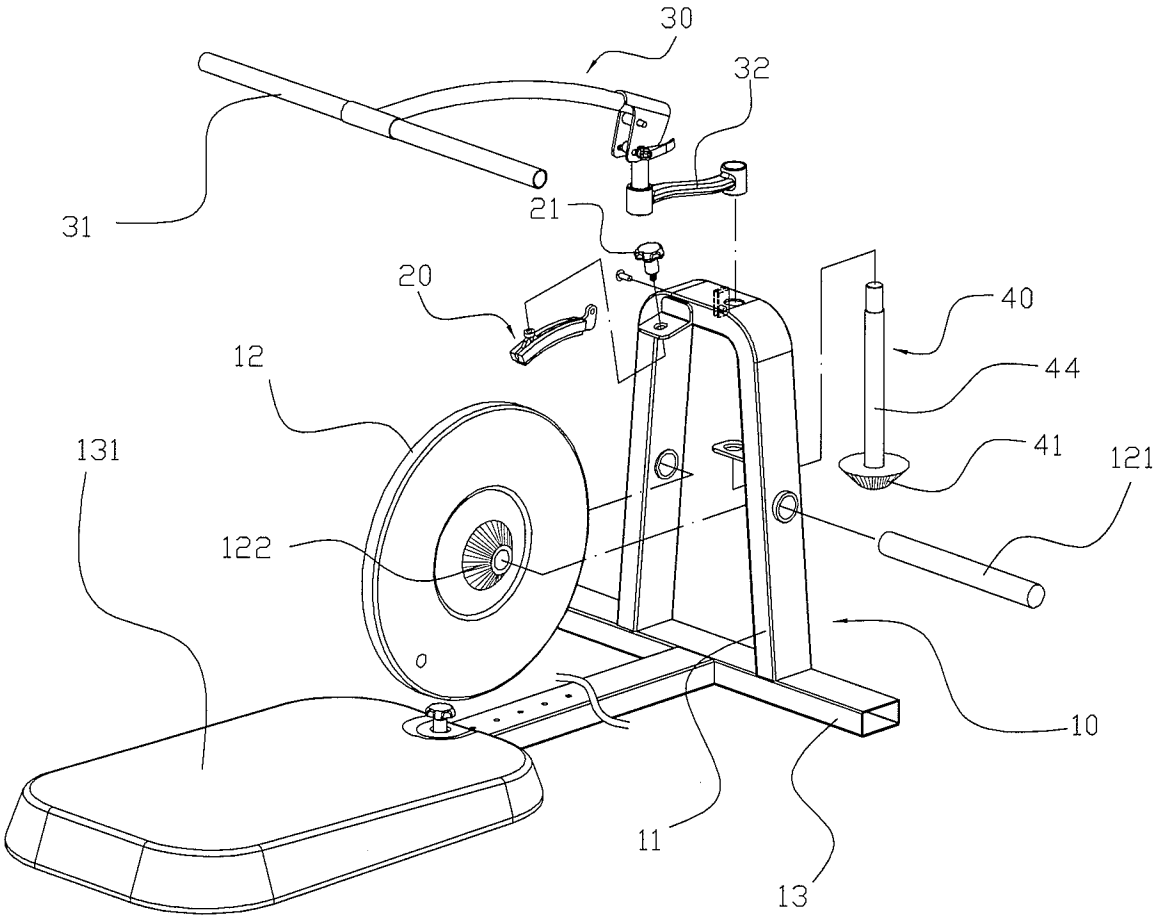
FIG. 15 is an exploded perspective view of the gyration type exercising device as shown in FIG. 14.
Figure 16:
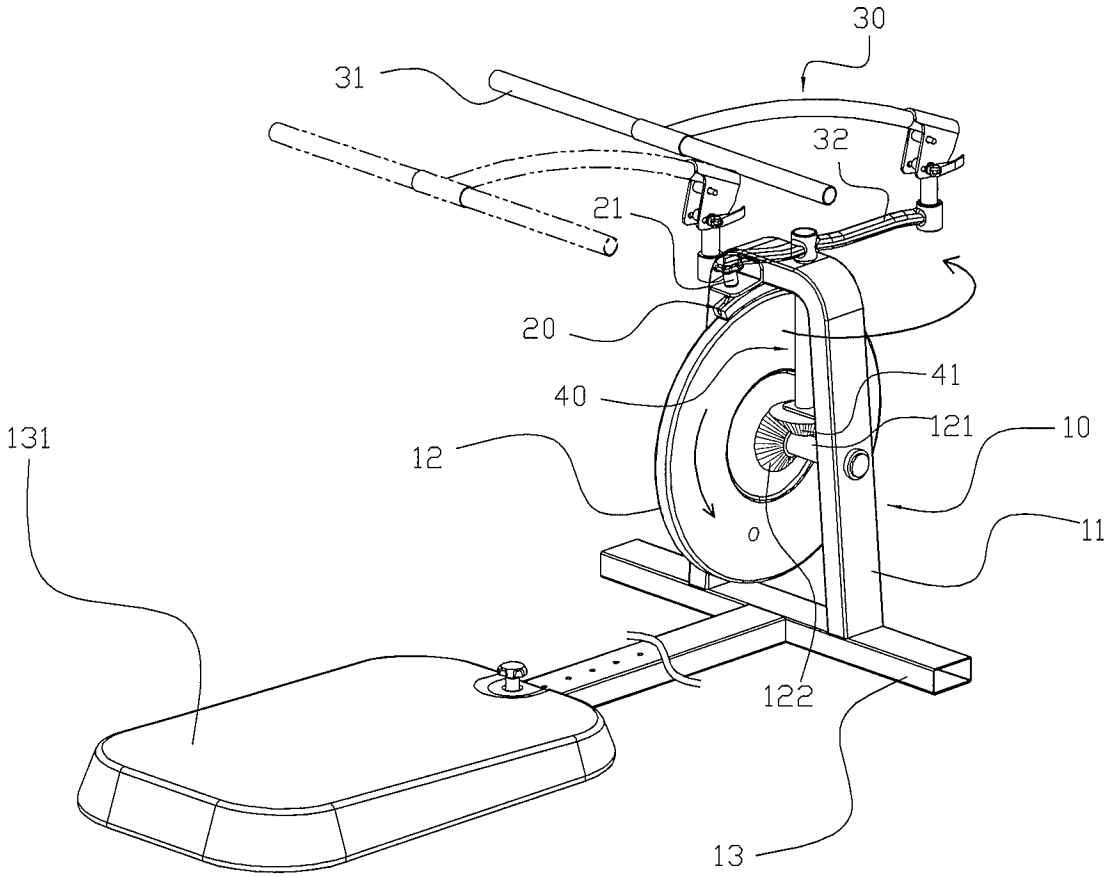
FIG. 16 is a schematic operational view of the gyration type exercising device as shown in FIG. 14.
Figure 17:
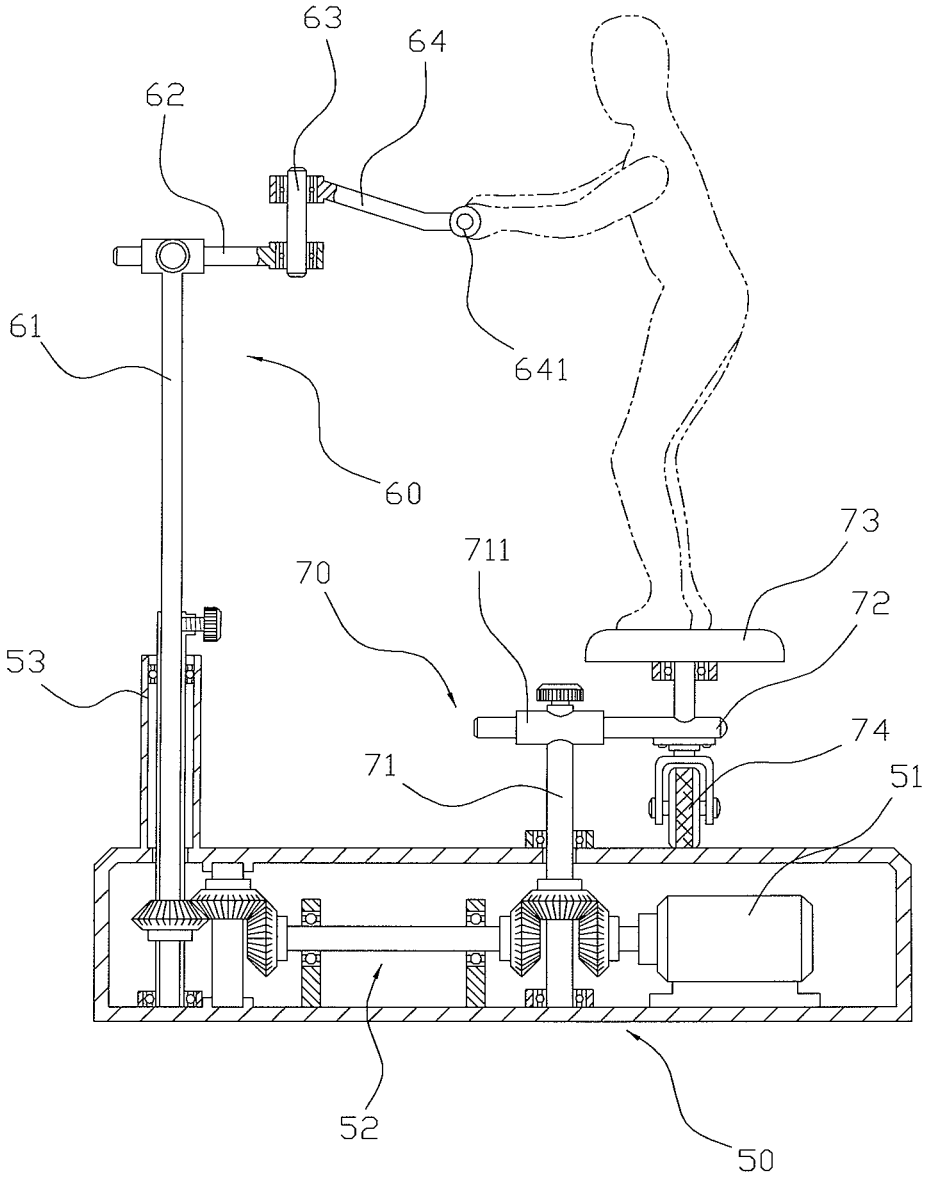
FIG. 17 PRIOR ART
FIG. 17 is a side cross-sectional view of a conventional exercising device in accordance with the prior art.

Referring to FIGS. 14-16, the rotation wheel 12 is disposed at an upright state, and the mounting frame 11 is also disposed at an upright state. The gyration unit 10 further includes a driven member 122 secured on the rotation wheel 12 to rotate the rotation wheel 12. The driven member 122 is rotatably mounted on the rotation shaft 121. Preferably, the driven member 122 of the gyration unit 10 is a bevel gear. The transmission mechanism 40 includes a drive member 44 rotatably mounted on the mounting frame 11 and a transmission member 41 mounted on the drive member 44 and engaging the driven member 122 to transmit a power of the drive member 44 to the driven member 122. Preferably, the drive member 44 is an upright rod, and the transmission member 41 is a bevel gear which is secured on a lower end of the drive member 44. The gyration type exercising device further comprises a crank 32 mounted between the transmission mechanism 40 and the drive handle 30 and having a first end secured on an upper end of the drive member 44 to rotate the drive member 44 and a second end pivotally connected with the drive handle 30 to move in concert with the drive handle 30. Thus, the crank 32 is driven by the drive handle 30 to rotate the drive member 44 which rotates the transmission member 41 which rotates the driven member 122 which rotates the rotation wheel 12 so that the rotation wheel 12 is rotated by driving of the drive handle 30.

Accordingly, when the user's two hands hold the holding bar 31 to move the drive handle 30 in a gyration manner, the user's body has to move forward and backward in a reciprocal manner and has to exert a force on the drive handle 30 successively to rotate the rotation wheel 12 reciprocally so as to exercise the user's body completely, thereby enhancing the exercising effect. In addition, the adjusting member 21 is movable on the mounting frame 11 to move the damper 20 relative to the rotation wheel 12 so as to adjust the resistance and damping force of the damper 20 applied on the rotation wheel 12.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. An exercising device, comprising:

a gyration unit;

a damper mounted on the gyration unit; and a drive handle pivotally connected with the gyration unit;

wherein the gyration unit includes:

a mounting frame; and a rotation wheel rotatably mounted on the mounting frame and driven by operation of the drive handle;

the rotation wheel of the gyration unit is provided with a rotation shaft which is rotatably mounted on the mounting frame; and the damper is mounted on the mounting frame of the gyration unit and has a side pressing a periphery of the rotation wheel to provide a damping force to the rotation wheel of the gyration unit to damp rotation of the rotation wheel.

2. The exercising device of claim 1, further comprising:

a tension adjusting member mounted on the mounting frame of the gyration unit and connected with the damper to move the damper relative to the rotation wheel of the gyration unit to adjust the damping force of the damper applied on the rotation wheel of the gyration unit;

a support rack mounted on a bottom of the mounting frame to support the mounting frame of the gyration unit;

a tread cushion mounted on a side of the support rack;

wherein the damper is pivotally connected with the mounting frame of the gyration unit; and the adjusting member is movable on the mounting frame of the gyration unit to pivot and move the damper relative to the rotation wheel of the gyration unit so as to adjust the damping force of the damper applied on the rotation wheel of the gyration unit.

3. The exercising device of claim 1, wherein:

the mounting frame of the gyration unit is placed on and supported by a table; and the rotation shaft is secured on and located at a central portion of the rotation wheel so that the rotation wheel is rotatable about the rotation shaft.

4. The exercising device of claim 1, wherein:

the drive handle is pivotally connected with the rotation wheel of the gyration unit;

the drive handle has a first end pivotally connected with the rotation wheel of the gyration unit and a second end provided with a holding bar; and the first end of the drive handle is arranged eccentrically on the rotation wheel of the gyration unit.

5. The exercising device of claim 1, wherein:

the rotation shaft protrudes outward from the rotation wheel of the gyration unit;

the gyration type exercising device further comprises a crank mounted between the rotation shaft and the drive handle and having a first end secured on the rotation shaft to rotate the rotation shaft and a second end pivotally connected with the drive handle to move in concert with the drive handle; and the crank is driven by the drive handle to rotate the rotation shaft so as to rotate the rotation wheel.

6. The exercising device of claim 1, further comprising a transmission mechanism mounted between the gyration unit and the drive handle to transmit a power of the drive handle to the gyration unit.

7. The exercising device of claim 6, wherein:

the gyration unit further includes a driven member secured on the rotation shaft to rotate the rotation shaft;

the transmission mechanism includes:

a drive member rotatably mounted on the mounting frame of the gyration unit; and a transmission member mounted between the drive member and the driven member of the gyration unit to transmit a power of the drive member to the driven member of the gyration unit;

the drive handle is pivotally connected with the transmission mechanism; and the drive handle has a first end pivotally connected with the drive member of the transmission mechanism and a second end provided with a holding bar.

8. An exercising device, comprising:

a gyration unit;

a damper mounted on the gyration unit- and a drive handle connected with the gyration unit;

a transmission mechanism mounted between the gyration unit and the drive handle to transmit a power of the drive handle to the gyration unit;

wherein:

the gyration unit includes:

a mounting frame; and a rotation wheel rotatably mounted on the mounting frame and driven by operation of the drive handle;

the rotation wheel of the gyration unit is provided with a rotation shaft which is rotatably mounted on the mounting frame;

the damper is mounted on the mounting frame of the gyration unit and has a side pressing a periphery of the rotation wheel to provide a damping force to the rotation wheel of the gyration unit;

the gyration unit further includes a driven member secured on the rotation shaft to rotate the rotation shaft;

the transmission mechanism includes:

a drive member rotatably mounted on the mounting frame of the gyration unit; and a transmission member mounted between the drive member and the driven member of the gyration unit to transmit a power of the drive member to the driven member of the gyration unit;

the drive handle is pivotally connected with the transmission mechanism;

the drive handle has a first end pivotally connected with the drive member of the transmission mechanism and a second end provided with a holding bar;

the driven member of the gyration unit is a driven wheel;

the drive member of the transmission mechanism is a drive wheel;

the transmission member of the transmission mechanism is a belt; and the first end of the drive handle is arranged eccentrically on the drive member of the transmission mechanism.

9. An exercising device, comprising:

a gyration unit;

a damper mounted on the gyration unit; and a drive handle connected with the gyration unit;

a transmission mechanism mounted between the gyration unit and the drive handle to transmit a power of the drive handle to the gyration unit;

wherein:

the gyration unit includes:

a mounting frame; and a rotation wheel rotatably mounted on the mounting frame and driven by operation of the drive handle;

the rotation wheel of the gyration unit is provided with a rotation shaft which is rotatably mounted on the mounting frame;

the damper is mounted on the mounting frame of the gyration unit and has a side pressing a periphery of the rotation wheel to provide a damping force to the rotation wheel of the gyration unit;

the gyration unit further includes a driven member secured on the rotation shaft to rotate the rotation shaft;

the transmission mechanism includes:

a drive member rotatably mounted on the mounting frame of the gyration unit; and a transmission member mounted between the drive member and the driven member of the gyration unit to transmit a power of the drive member to the driven member of the gyration unit;

the drive member of the transmission mechanism has a central portion provided with a rotation rod;

the gyration type exercising device further comprises a crank mounted between the transmission mechanism and the drive handle and having a first end secured on the rotation rod to rotate the rotation rod and the drive member and a second end pivotally connected with the drive handle to move in concert with the drive handle; and the crank is driven by the drive handle to rotate the rotation rod which rotates the drive member which drives the transmission member which drives the driven member which drives the rotation shaft which rotates the rotation wheel.

10. The exercising device of claim 6, wherein:

the gyration unit further includes a driven member secured on the rotation wheel to rotate the rotation wheel;

the transmission mechanism includes:

a drive member rotatably mounted on the mounting frame; and a transmission member mounted on the drive member and engaging the driven member to transmit a power of the drive member to the driven member;

the gyration type exercising device further comprises a crank mounted between the transmission mechanism and the drive handle and having a first end secured on an upper end of the drive member to rotate the drive member and a second end pivotally connected with the drive handle to move in concert with the drive handle; and the crank is driven by the drive handle to rotate the drive member which rotates the transmission member which rotates the driven member which rotates the rotation wheel.

11. The exercising device of claim 10, wherein:

the rotation wheel is disposed at an upright state;

the mounting frame is also disposed at an upright state;

the driven member is rotatably mounted on the rotation shaft;

the driven member of the gyration unit is a bevel gear;

the drive member is an upright rod;

the transmission member is a bevel gear; and the transmission member is secured on a lower end of the drive member.

* * * * *